US006378712B1

(12) United States Patent
Sampl

(10) Patent No.: US 6,378,712 B1
(45) Date of Patent: Apr. 30, 2002

(54) WHATNOT

(76) Inventor: Alois Sampl, A-5582, St. Margarethen Im Lungau 66 (AT)

( * ) Notice: Subject to any disclaimer, the term of this patent is extended or adjusted under 35 U.S.C. 154(b) by 0 days.

(21) Appl. No.: 09/503,329

(22) Filed: Feb. 14, 2000

(51) Int. Cl.[7] ..... A47F 5/00
(52) U.S. Cl. ..... 211/186; 211/187; 108/107
(58) Field of Search ..... 211/186, 187, 211/190, 191; 108/106, 107, 180

(56) References Cited

U.S. PATENT DOCUMENTS

| | | | | |
|---|---|---|---|---|
| 1,411,260 A | * | 4/1922 | Baker et al. | |
| 3,179,257 A | * | 4/1965 | Tassell | |
| 3,207,322 A | * | 9/1965 | Pederson | |
| 3,280,527 A | * | 10/1966 | Faust | |
| 3,587,483 A | * | 6/1971 | Konstaut | |
| 3,589,746 A | * | 6/1971 | Inglis | |
| 3,654,887 A | * | 4/1972 | Iwami | |
| 3,724,678 A | * | 4/1973 | Challier | |
| 4,173,934 A | * | 11/1979 | Searley | 211/190 X |
| 5,022,721 A | | 6/1991 | Melgers | |
| 5,054,404 A | * | 10/1991 | Melgers | 108/107 X |
| 5,842,586 A | * | 12/1998 | Melby | 211/187 |
| 5,911,180 A | * | 6/1999 | Mullens | 108/180 X |

FOREIGN PATENT DOCUMENTS

| | | |
|---|---|---|
| FR | 2525664 | 10/1983 |
| FR | 2629150 | 9/1989 |

* cited by examiner

*Primary Examiner*—Robert W. Gibson, Jr.
(74) *Attorney, Agent, or Firm*—Dykema Gossett PLLC

(57) ABSTRACT

A whatnot has upright posts, crossbeams and shelves, the upright posts being arranged vertically and each upright post is provided with at least one groove extending alongside the upright post and widening in inward direction thereof, wherein the crossbeams are provided at their ends with projections intended to be received by the groove in order to create a connection between the upright posts and the crossbeams, and wherein the shelves are connected to the crossbeams. The crossbeams are positioned in the grooves of the upright posts by shelf supports that are inserted into the upright posts. A stable and easy to dismantle whatnot is achieved by the fact that the shelves are removably connected to the crossbeams by means of dowels.

3 Claims, 4 Drawing Sheets

WHATNOT

BACKGROUND OF THE INVENTION

The present invention relates to a whatnot according to the preamble of claim 1.

DESCRIPTION OF THE PRIOR ART

FR 2,525,664 A discloses a whatnot provided with upright posts of a square section that have on either side a dovetailed groove. Fasteners interconnecting the upright posts are inserted in the groove. Additionally, the groove may also take hold of a rear wall on one side of the whatnot. The shelves are just resting on the fasteners and do not serve any static purposes. When embodied in an appropriate manner, such a whatnot is stable and easy to dismantle, its disadvantage however is that the useful height of the shelf is considerably restricted by the necessary fasteners. Depending on the required height of the different compartments, between 20% and 50% of the structure's volume is thus left unused.

FR 2,629,150 A describes a whatnot with upright posts that are also held together by crossbeams. In order to achieve a sufficient stability of the whatnot, it requires in any case a closed rear wall at the back or at least a broad fastener arranged in longitudinal direction. In many cases, a rear wall is unwanted, in order for example to permit free sight through the whatnot, and in addition, a fastener arranged in longitudinal direction restricts the access to the different shelves.

Furthermore, U.S. Pat. No. 5,022,721 discloses a procedure by which shelves are positioned in a whatnot by means of dowel connections. In this case however, the whatnot is stable in itself thanks to bonding connections, the dowel connections only serving to prevent the shelves from getting displaced.

SUMMARY OF THE INVENTION

It is an object of the present invention to provide a whatnot that may be assembled easily and without any special skills and that may be dismantled again just as easily. It aims at getting along with mainly patch plugs and the like, i.e., at avoiding the use of screws, nails or glues. The whatnot has thereby to be stable and to yield free access to the different compartments.

According to the invention, the shelves are removably connected to the crossbeams by means of dowels.

The solution according to the invention makes it possible to use the shelves as static elements, which are conferring stability on the whatnot. Since neither screw connections nor bonding connections have been thought of, easy assembly of the whatnot can be assured, its dismantling also turning out to be fast and free of trouble. The whatnot according to the invention may be erected in warehouses, in offices, in rooms, in public buildings, and so on, in order to store objects in a clearly arranged and space-saving way. To assemble the whatnot, no tools or technical instruments are required and, since wood has been used for all component parts, disposal is no problem.

Access to the shelves can be particularly free when the crossbeams are arranged on the narrow sides of the whatnot.

Stability of the whatnot may be increased in particular by having each shelf provided at either end with two crossbeams, one of them being arranged underneath the shelf and the other one above the shelf.

Particularly easy assembly of the whatnot according to the invention is achieved by having the upright posts connected in pairs by crossbeams and by having the pairs of upright posts interconnected by crossbeams exclusively connected to each other by the shelves. Thus, a minimum of component parts may be sufficient.

BRIEF DESCRIPTION OF THE DRAWINGS

The present invention will be explained thereafter in more details with the aid of the embodiments illustrated in the figures.

DETAILED DESCRIPTION OF THE PREFERRED EMBODIMENTS

Figure 1:
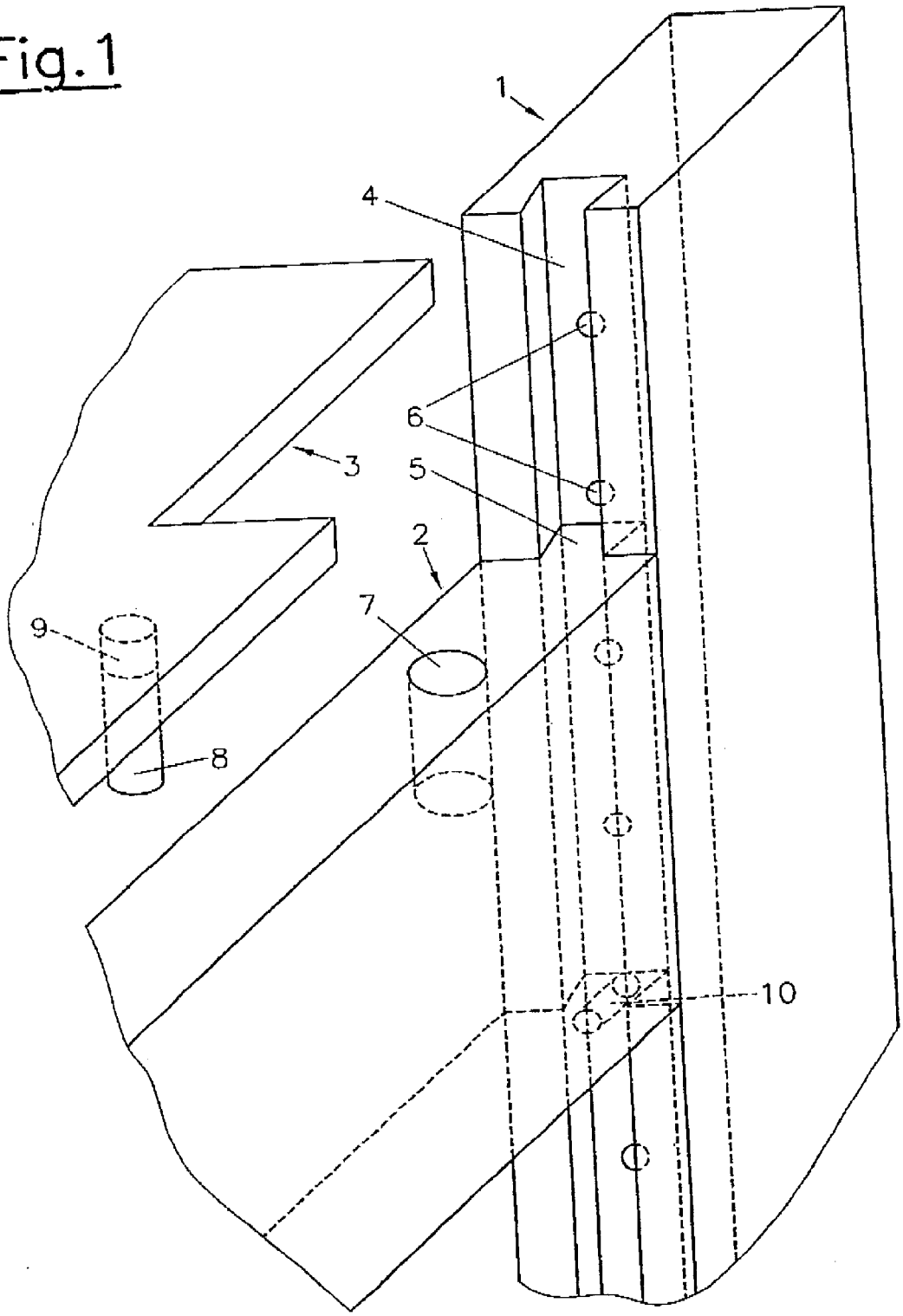
FIG. 1 is an axonometric view of a detail of a whatnot according to the invention.
Figure 2:
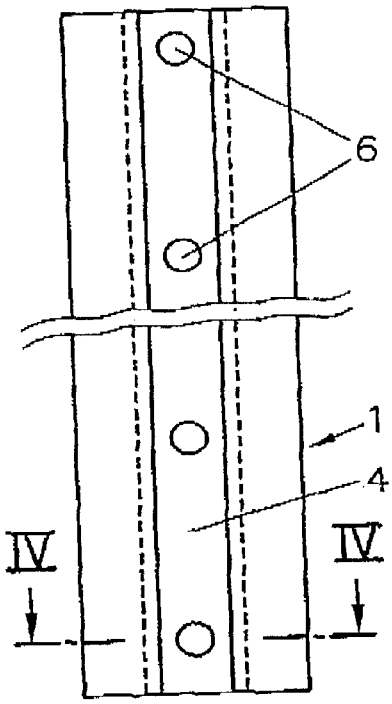
FIG. 2 and 3 are views of an upright post.
Figure 3:
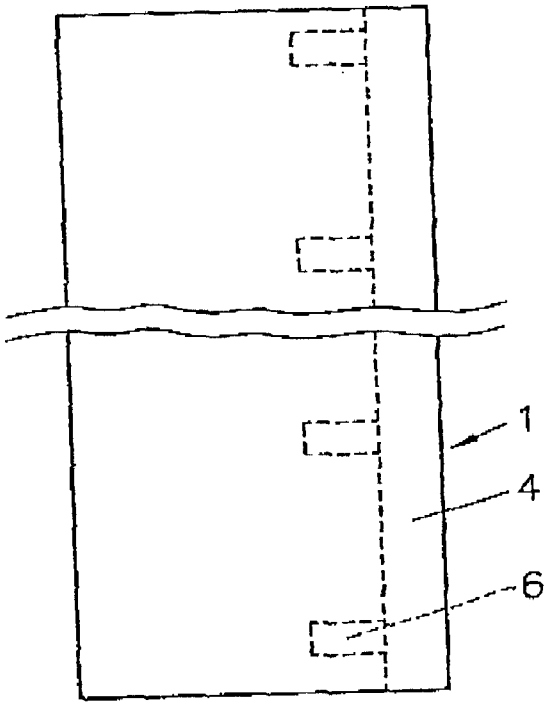
Figure 4:
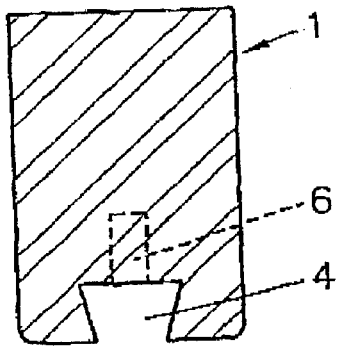
FIG. 4 is a section taken along the line IV—IV in FIG. 2, FIG. 5 through 7 are views of a crossbeam.
Figure 5:
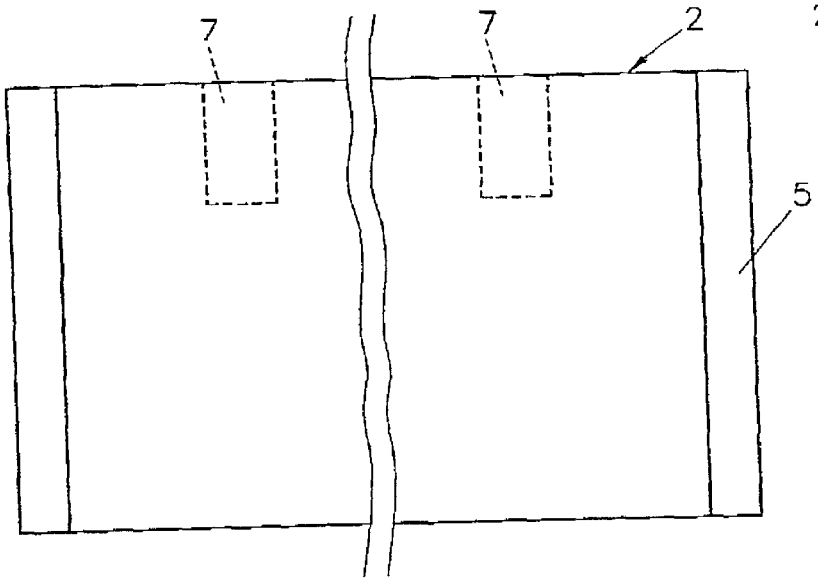
Figure 6:
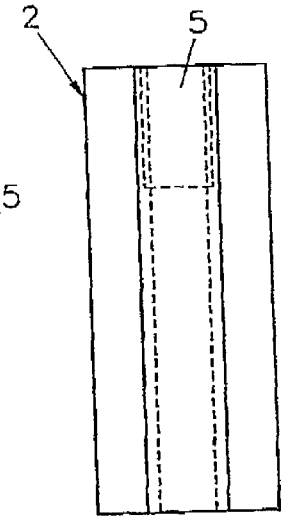
Figure 7:
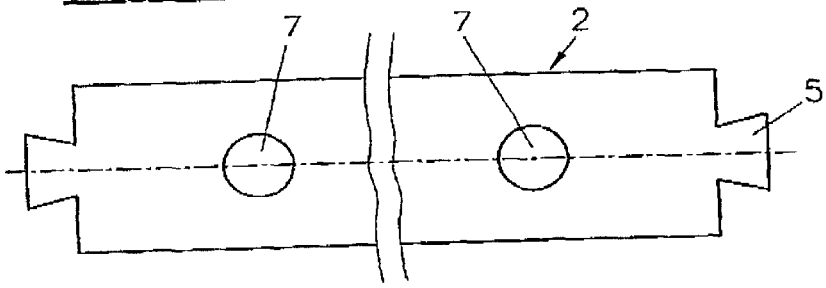

A basic whatnot consists of four upright posts 1 having a length of between 860 mm and 2580 mm. The dimension of the cross section is for example of 50 mm by 30 mm.

The upright post 1 has a dovetailed groove 4 extending throughout its length on its narrow side. Size and shape of this groove 4 depends on the measurements of the upright post's 1 cross section, which in its turn has been given measurements according to the load of the whole structure.

Crossbeams 2 are inserted into the groove 4 and are provided at their ends with projections 5, which are adapted to the cross section of the groove 4. A series of bores 6, whose diameter depends on the load of the individual shelves and compartments, are located inside the groove 4. The upright posts 1 absorb all the forces acting upon the whatnot.

The length of the crossbeams 2 depends on the depth and the utilization of the whatnot. The projections 5 at the ends of the crossbeams 2 are designed in such a manner so that they may be inserted into the groove 4 of the upright posts 4 with just a little play. The width of the crossbeams 2 is for example of 86 mm but depends essentially on the load of the whole structure. Shelf supports or pegs 10 for the crossbeams 2 to rest on are inserted at the same height into the bores 6 in the upright posts 1. By accommodating at least two crossbeams, stability of the construction is achieved.

The undersides of the shelves 3 are provided with bores 9 mating with the bores 7 of the crossbeams 2. Thanks to dowels 8, the connection between the crossbeams 2 and the shelves 3 may be created, so that the whatnot as a whole becomes stable. The individual shelves 3 may be adjusted in height without having to dismantle the whole whatnot.

A further whatnot may be added to the basic whatnot consisting of at least four upright posts 1, four crossbeams 2 and two shelves 3, and only requires one more whatnot side for receiving the various, height adjustable shelves. The extension of the whatnot may thus be continued ad lib. Different heights may also be combined.

Figure 8:
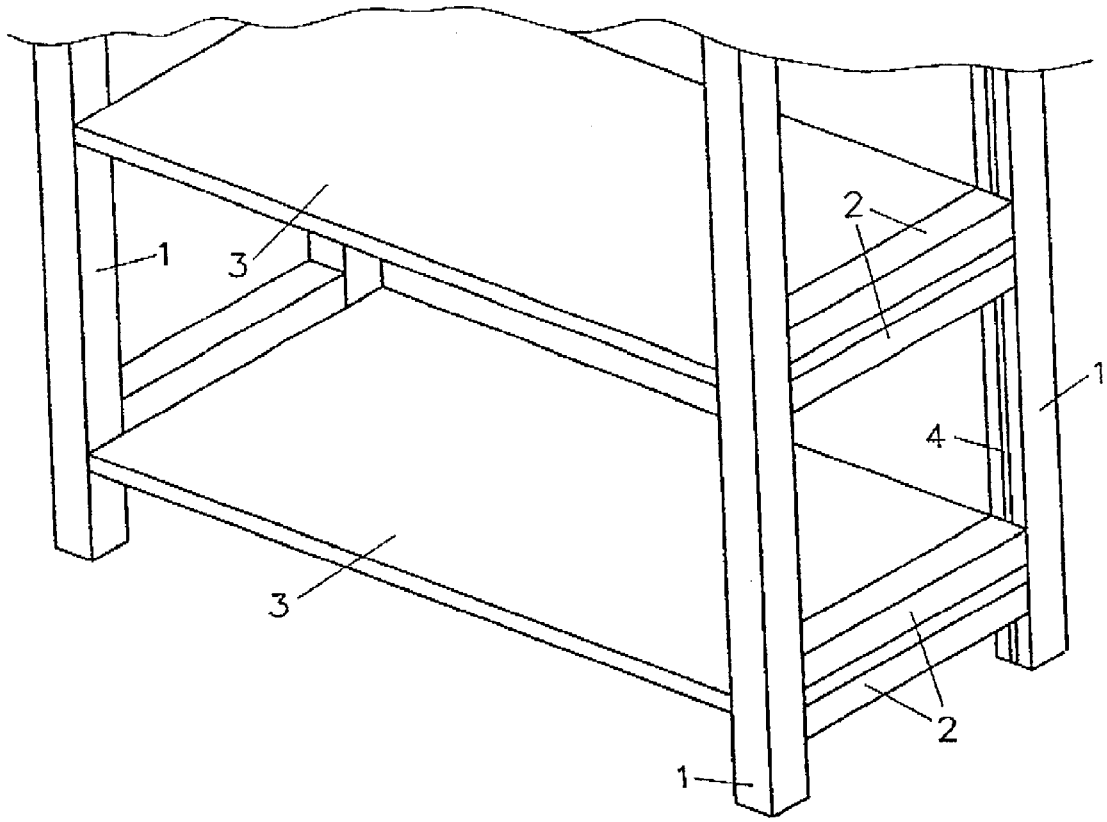
FIG. 8 is a partially axonometric view of another embodiment of the invention.

In the embodiment according to FIG. 8, four upright posts 1 are provided, wherein two upright posts 1, which are accommodated on one narrow side of the whatnot, are held together by means of crossbeams 2. The crossbeams 2 are thereby arranged directly underneath or directly above a shelf 3 and are gripping it between the two of them. The dowels 8, which are not illustrated in FIG. 8, are arranged in the crossbeams 2 in blind bores facing each other in such a manner so that they are not visible and cannot get lost, and extend through accordingly arranged bores in the shelves 3. The whatnot according to FIG. 8 is characterized by its specific stability.

What is claimed is:

1. A whatnot that is composed of upright posts, crossbeams and shelves, wherein the upright posts are arranged vertically and each upright post is provided with at least one groove extending alongside the upright post and widening in an inward direction thereof, wherein the crossbeams are provided at their ends with projections intended to be received by the grooves in order to create a connection between the upright posts and the crossbeams, wherein the crossbeams are positioned in the grooves of the upright posts by shelf supports that are inserted into the upright posts, wherein each shelf is provided at either end with two crossbeams, a first crossbeam being arranged underneath the shelf and a second crossbeam being arranged above the shelf, and including dowels for removably connecting the shelves to the crossbeams.

2. A whatnot according to claim 1, wherein the whatnot defines long sides and narrow sides and wherein the crossbeams are arranged on the narrow sides.

3. A whatnot according to claim 1, wherein the upright posts are connected in pairs by crossbeams and wherein pairs of upright posts interconnected by crossbeams are exclusively connected to each other by shelves.

* * * * *